US008728697B2

(12) United States Patent
Ishizuka

(10) Patent No.: US 8,728,697 B2
(45) Date of Patent: May 20, 2014

(54) CARRIER FOR ELECTROSTATIC IMAGE DEVELOPER, ELECTROSTATIC IMAGE DEVELOPER, TONER CARTRIDGE, PROCESS CARTRIDGE, AND IMAGE FORMING APPARATUS

(75) Inventor: Daisuke Ishizuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 611 days.

(21) Appl. No.: 12/855,218

(22) Filed: Aug. 12, 2010

(65) Prior Publication Data

US 2011/0217643 A1 Sep. 8, 2011

(30) Foreign Application Priority Data

Mar. 4, 2010 (JP) ..... 2010-048377

(51) Int. Cl.
*G03G 9/113* (2006.01)
*G03G 9/097* (2006.01)

(52) U.S. Cl.
USPC ..... 430/111.35; 430/108.2; 430/111.1

(58) Field of Classification Search
USPC ..... 430/111.1, 111.35, 108.2
See application file for complete search history.

(56) References Cited

U.S. PATENT DOCUMENTS 5,171,653 A * 12/1992 Jugle et al. ..... 430/108.3
5,215,845 A 6/1993 Yusa et al.
5,840,458 A * 11/1998 Kido et al. ..... 430/108.6
5,968,699 A * 10/1999 Matsuzaki et al. ..... 430/111.35
7,275,808 B2 10/2007 Katsuyama et al.
2004/0067189 A1* 4/2004 Sugiura et al. ..... 423/335
2005/0214671 A1* 9/2005 Mizutani et al. ..... 430/111.35
2006/0222982 A1* 10/2006 Fujikawa ..... 430/106.1
2007/0003854 A1 1/2007 Matsui
2007/0048651 A1 3/2007 Nakamura

FOREIGN PATENT DOCUMENTS

JP A 5-303235 11/1993
JP A-06-242634 9/1994
JP A 10-333350 12/1998
JP A 2004-325895 11/2004
JP A 2004-333965 11/2004
JP A-2005-274763 10/2005
JP A 2007-041549 2/2007
JP A-2007-057659 3/2007
JP A-2007-219118 8/2007
JP A-2009-204695 9/2009
JP A-2010-014851 1/2010

OTHER PUBLICATIONS

Aug. 24, 2011 Office Action issued in Australian Application No. 2010212447.
Office Action issued in Australian Patent Application No. 2010212447 dated Mar. 31, 2011.
Dec. 10, 2013 Japanese Office Action issued in JP-2010-048377 (with English-language Translation).

* cited by examiner

*Primary Examiner* — Jonathan Jelsma
(74) *Attorney, Agent, or Firm* — Oliff PLC

(57) ABSTRACT

A carrier for electrostatic image development includes: a carrier body including a core and a resin coating layer on the core; and first spherical silica particles having a volume-average particle diameter of from 50 nm to 300 nm that adhere to the surface of the carrier body at a ratio of from 0.001 parts by weight to 0.100 parts by weight relative to 100 parts by weight of the carrier body.

19 Claims, 3 Drawing Sheets

CARRIER FOR ELECTROSTATIC IMAGE DEVELOPER, ELECTROSTATIC IMAGE DEVELOPER, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2010-048377 filed Mar. 4, 2010.

BACKGROUND

1. Technical Field

The present invention relates to a carrier for electrostatic image developer, an electrostatic image developer, a toner cartridge, a process cartridge, and an image forming apparatus.

2. Related Art

Two-component development systems in which a toner and a carrier are mixed are used as electrophotographic development systems. In two-component development systems, a magnet roller (development roller) is used as a developer holder, a carrier accommodated in a development device forms a chain-like brush (magnetic brush) between the development roller and a surface of an image holder (photoreceptor), and a toner electrostatically transfers to a surface of the photoreceptor by rubbing the surface of the photoreceptor, on which an electrostatic latent image is formed, with the magnetic brush, whereby a toner image is obtained.

SUMMARY

According to an aspect of the invention, there is provided a carrier for electrostatic image development, including:

a carrier body including a core and a resin coating layer on the core; and first spherical silica particles having a volume-average particle diameter of from 50 nm to 300 nm that adhere to the surface of the carrier body at a ratio of from 0.001 parts by weight to 0.100 parts by weight relative to 100 parts by weight of the carrier body.

BRIEF DESCRIPTION OF THE DRAWINGS

Exemplary embodiments of the present invention will be described in detail based on the following figures, wherein.

DETAILED DESCRIPTION

Figure 1:
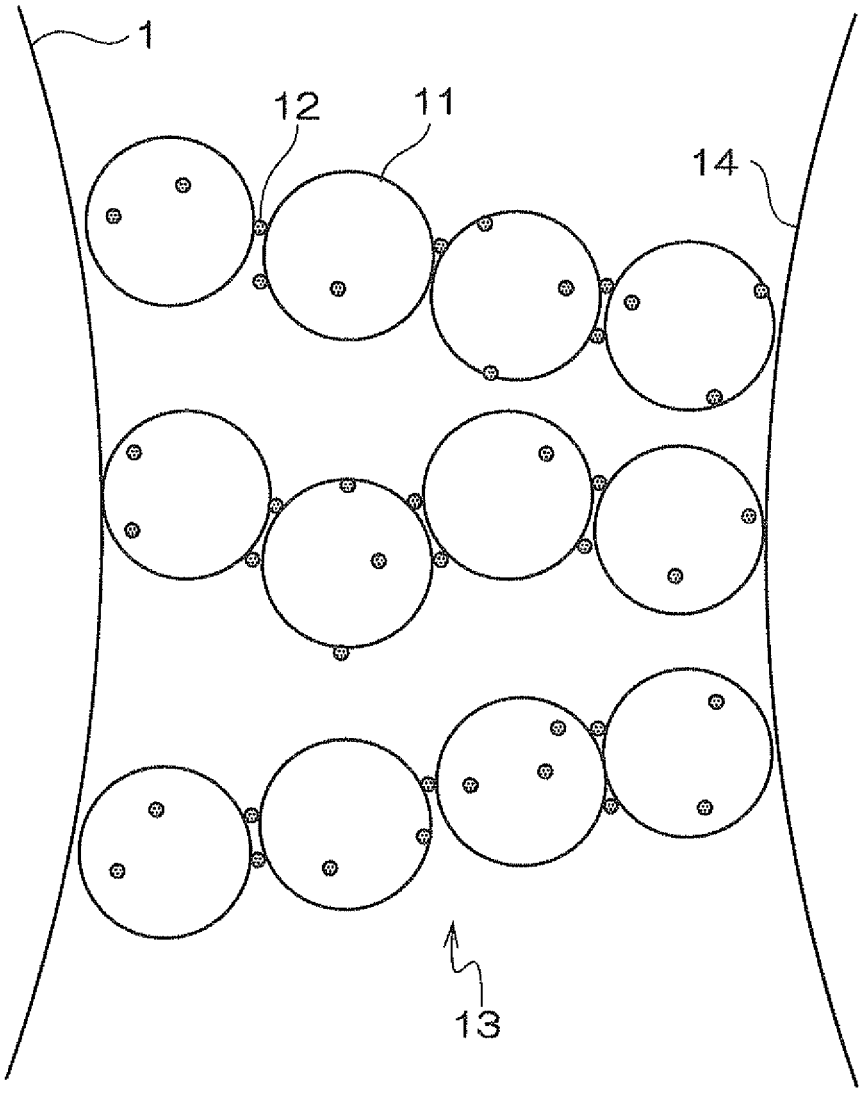
FIG. 1 is a diagram schematically illustrating a magnetic brush formed by a carrier according to an exemplary embodiment of the invention.

When an image holder of which the surface abrasion is suppressed, such as an image holder (amorphous silicon image holder) of which the surface is formed of amorphous silicon, is used, toner components (e.g., an external additive) that have adhered to a surface of the image holder is difficult to remove due to the suppressed abrasion of the surface of the image holder, resulting in local adhesion of the external additive component. In so-called against-development, an image holder and a development roller rotate in the same rotational direction so that, in an area where the image holder and the development roller are closest to each other and a toner image is formed, the movement direction of the circumferential surface of the image holder and the movement direction of the circumferential surface of the development roller are opposite to each other. In the case of the against-development, since the rubbing speed of the magnetic brush on the image holder is high, adhesion of only external additive to the surface of the image holder easily occurs. This tendency is higher in high-speed machines.

When a halftone image is printed in the state in which the adhesion of external additive occurs, an image density difference occurs between a region at which adhered matter is present on the image holder and a region at which adhered matter is not present on the image holder, as a result of which image quality deteriorates. Particularly, in a case in which the same pattern is continuously printed in large volume and thereafter a halftone image is printed, remarkable image density difference occurs in some cases. Since the image density difference due to the adhesion of external additive is conspicuous after continuous image formation of a band-like pattern is performed, image density difference of this kind is herein referred to as "band-like image density unevenness".

The inventor has studied the phenomenon whereby remarkable image density difference is generated in a halftone image printed after continuous printing of a same image pattern. The inventor has found that the image density difference is generated by adhesion of external additive in the toner to the surface of the image holder, that external additive adhered to the surface of the image holder is gradually removed during repeated image formation and thus band-like image density unevenness ceases to occur, and that there is a high tendency for band-like image density unevenness to occur directly after replacement of developer.

As a result of extensive study, the inventor has found that the properties of developer after the developer has deteriorated is different from the properties of fresh developer, and that the level of band-like image density unevenness changes depending on the presence of spherical particles on the cleaning blade. Based on these findings, the inventor has found that the generation of band-like image density unevenness and change in image density at the time of repeated image formation may be effectively suppressed by using a developer including toner particles and carrier particles having spherical silica particles that are adhered to the surface of the carrier particles and that have a particle diameter in a specific range, which is obtained by mixing the spherical silica particles with the carrier particles at a specific ratio, as a result of which the present invention has been made.

Although the mechanism thereof is not completely clear, the mechanism is presumed to be as follows.

Specifically, it is presumed that: the strength of the magnetic brush when the magnetic brush rubs the image holder is a factor involved in acceleration of the adhesion of external additive to the image holder, which causes band-like image density unevenness; in the case that carrier particles in which the surfaces of magnetic substance particles are coated with a resin layer is used, the surface properties of the carrier particles change due to abrasion of the coating layer or the conductive material within the coating layer being exposed on the surface during use of the developer; as a result, the attraction force between the carrier particles and the fluidity of the carrier particles change, the rubbing force of the magnetic brush is weakened in comparison with fresh carrier, and the transfer of the external additive to the image holder is reduced; that is, as a result of the change in the coating layers of the carrier particles over time, band-like image density unevenness is more likely to occur with fresh carrier.

As shown in FIG. 1, it is presumed that: when a magnetic brush has been formed by carrier body particles 11 aligned in a chain shape around a developer holder 14, the presence of spherical silica particles 12 on the surfaces of the carrier body particles 11 decreases the attraction force between the carrier body particles 11; since the silica particles 12 have a spherical shape, the silica particles 12 roll between the carrier body particles 11, thereby improving the rolling properties between the carrier body particles 11, decreasing the rubbing force of the magnetic brush 13 against the surface of the image holder 1, and thus suppressing the generation of band-like image density unevenness.

It is further presumed that: as printing is continued, the spherical silica particles 12 adhered to the surfaces of the carrier body particles 11 adhere to toner particles (not shown) and are developed together with the toner particles, as a result of which the amount of the spherical silica particles 12 in the developer gradually decreases; accordingly, since an increase in rubbing force of the magnetic brush 13 over time due to a decrease in the amount of spherical silica particles on the surface of the carrier body particles is canceled by a decrease in rubbing force due to the abrasion of the coating layer, as a result of which stable suppression of adhesion of external additive to the image holder may be achieved without affecting development performance.

It is further presumed that: the spherical silica particles 12 developed along with the toner particles stay at the portion of contact with the cleaning blade, and thus the rolling silica particles are present at the contact portion; as a result, external additive adhered to the image holder 1 may be uniformly removed and the generation of band-like image density unevenness may be more effectively suppressed.

The spherical silica particles are particularly effective as compared with organic particles, in that the spherical silica particles are resistant to deformation by a stress in the development device, have higher tendency to be uniformly distributed on the surfaces of the carrier particles due to their decreased tendency to form an aggregate, and cause less influence on the electric resistance of the developer due to their high electric resistance.

Hereinafter, the carrier and the developer according to the present exemplary embodiment are more specifically described.

Carrier

The carrier for electrostatic image development according to the present exemplary embodiment includes a carrier body and spherical silica particles having a volume-average particle diameter of from 50 nm to 300 nm that adhere to the surface of the carrier body at a ratio of from 0.001 parts by weight to 0.100 parts by weight relative to 100 parts by weight of the carrier body.

The carrier in which the spherical silica particles are adhered to the surface of the carrier body may be obtained by adding the spherical silica particles having the above particle diameter to the carrier body at the above ratio and mixing the resultant using a mixer such as a V-shaped mixer, a HENSCHEL (trademark) mixer, or a TURBULA (trademark) mixer.

Carrier Body

A known carrier body including a core and a resin coating layer on the core may be used as the carrier body according to the present exemplary embodiment. The surface roughness Ra of the carrier body is preferably in the range of from 0.6 μm to 3.0 μm (or about 0.6 μm to about 3.0 μm), more preferably in the range of from 0.7 μm to 2.5 μm, and still more preferably in the range of from 0.8 μm to 2.0 μm. When Ra is equal to or greater than 0.6 μm, the force of adhesion of the spherical silica particles to the carrier body may not be excessively small, the silica particles may be hard to detach from the surface of the carrier body, control of the fluidity of the carrier may be easier, and control of the rubbing force of the magnetic brush may be easier. When Ra is equal to or less than 3.0 μm, the spherical silica particles may have lower tendency to gather in depressed portions of the carrier body, control of the fluidity of the carrier may be easier, and control of the rubbing force of the magnetic brush may be easier.

Here, the surface roughness Ra of the carrier body is a value obtained by measuring 100 carrier body particles with a laser microscope VK-9500 (manufactured by KEYENCE Corporation) and averaging the measured values.

For example, when a carrier body in which a ferrite core is coated with a resin is used, the surface roughness Ra of the carrier body is controlled by controlling, for example, the composition of the ferrite core, the manufacturing conditions, the amount of the coating resin, and the amounts of internal additives in the resin coating layer.

Examples of the material of the core of the carrier body include a magnetic metal such as iron, nickel, or cobalt, and a magnetic oxide such as a ferrite or a magnetite. The material of the core of the carrier body is more preferably a ferrite containing at least one of calcium, manganese, magnesium, cooper, nickel, zinc, lithium, strontium, or the like, and a ferrite containing at least one of manganese, magnesium, or strontium (such as manganese-magnesium-strontium ferrite) is preferable due to higher tendency to provide flexibility of the magnetic brush chain.

The volume-average particle diameter of the core particles of the carrier particles is generally in the range of from 10 μm to 200 μm, and preferably in the range of from 20 μm to 90 μm from the viewpoints of carrier scatter prevention, image density uniformity, and thin line reproducibility.

Examples of the coating resin used in the carrier body include polyethylene, polypropylene, polystyrene, poly(vinyl acetate), poly(vinyl alcohol), poly(vinyl butyral), poly (vinyl chloride), poly(vinyl ether), poly(vinyl ketone), a vinyl chloride-vinyl acetate copolymer, a styrene-acrylic acid copolymer, a straight silicone resin (a methyl silicone resin or a methyl phenyl silicone resin) having an organosiloxane bond or a modified resin thereof, a fluororesin, polyester, polycarbonate, a phenol resin, and an epoxy resin, but the coating resin is not limited to these examples.

Examples of a conductive material used in a coating material of the carrier body include a metal such as gold, silver, or copper, titanium oxide, zinc oxide, barium sulfate, aluminum borate, potassium titanate, tin oxide, and carbon black, but the conductive material is not limited to these examples.

Coating the surface of the core of the carrier body with a resin may be performed by a method of applying a coating layer forming solution in which the coating resin and, optionally, various additives are dissolved in a suitable solvent. The solvent is not particularly limited, and may be suitably selected in consideration of the coating resin to be used, suitability for coating, and the like.

Examples of the method of coating with a resin include an immersion method of immersing the core of the carrier in the coating layer forming solution, a spray method of spraying the coating layer forming solution to the surface of the core of the carrier, a fluidized-bed method of spraying the coating layer forming solution while the carrier core is floated by flowing air, and a kneader coater method of mixing the carrier core with the coating layer forming solution in a kneader coater and removing the solvent.

From the viewpoints of carrier scatter prevention, image density uniformity, and thin line reproducibility, the volume-average particle diameter of the carrier body particles is preferably in the range of from 10 μm to 200 μm (or from about 10 μm to about 200 μm), and more preferably in the range of from 20 μm to 90 μm.

The carrier body according to the present exemplary embodiment may include a core and a resin coating layer that covers the core and that contains a conductive material and a resin such that the content of the conductive material is smaller at the surface-side portion of the resin coating layer than at the core-side portion of the resin coating layer.

In a case in which the carrier resistance is controlled by the presence of a large amount of conductive material on the surface of the carrier body, adhesion of the spherical silica particles decreases the conductivity; therefore, there is higher tendency for the resistance of the magnetic brush to be changed by the status of the presence of the silica particles, and thus image density and/or thin line reproducibility is affected in some cases. Accordingly, a decrease of the amount of conductive material present in the vicinity of the carrier particle surface may reduce the influence of the silica particles on the electric resistance, and may more effectively suppress the generation of band-like image density unevenness without affecting image quality.

Forming the outermost surface of the carrier body from a cross-linked resin may increase the hardness of the outermost surface of the resin coating layer, and may thus suppress embedding of the silica particles into the coating layer, and maintains a state in which the silica particles easily roll on the surface of the carrier body.

The content of the conductive material in the resin coating layer may be controlled, for example, by preparing two or more kinds of resin layer forming solutions having different conductive material contents and sequentially applying, onto the core surface, the resin layer forming solutions one on another in decreasing order of the conductive material content.

Spherical Silica Particles

The spherical silica particles according to the present exemplary embodiment can be obtained, for example, by a sol-gel method, which is a wet method.

The particle diameter of the spherical silica particles may be freely controlled by controlling the hydrolysis in the sol-gel method, the weight ratios of alkoxysilane, ammonia, alcohol, and water in the condensation polymerization, the reaction temperature, the agitation speed, and the supply rate. The spherical shape is also obtained by this method.

An example of the sol-gel method is described below. Specifically, tetramethoxy silane is dropwise added to water, alcohol and ammonia water as a catalyst and agitated at an increased temperature.

The silica sol suspension obtained by the reaction is centrifugally separated into wet silica gel, alcohol, and ammonia water. A solvent is added to the wet silica gel so as to return the state to the silica sol state, and a hydrophobizing agent is added thereto so as to hydrophobize the silica surface. The hydrophobizing agent may be selected from general silane compounds.

The solvent is removed from the hydrophobized silica sol, and the silica sol is dried and sieved, as a result of which a desired monodisperse spherical silica is obtained. The obtained silica may be processed again. Methods of producing monodisperse spherical silica that can be used in the present exemplary embodiment are not limited to the above method.

A water-soluble silane compound is used as the silane compound used in the above method. Examples of the silane compound include compounds represented by Structural Formula (I).

$$R_aSiX_{4-a} \quad (I)$$

In Formula (I), a represents an integer in the range of from 0 to 3, R represents an organic group such as a hydrogen atom, an alkyl group, or an alkenyl group, and X represents a hydrolysable group such as a chlorine atom, a methoxy group, or an ethoxy group.

Examples of compounds represented by Structural Formula (I) include chlorosilane, alkoxy silane, silazane, and a special silylation agent. Specifically, typical examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

Examples of the hydrophobizing agent in the present exemplary embodiment include dimethyldimethoxysilane, hexamethyldisilazane, methyltrimethoxysilane, isobutyltrimethoxysilane, and decyltrimethoxysilane.

The term "spherical shape" as used in connection with the silica particles adhered to the carrier body in the present exemplary embodiment is defined in terms of Wadell's sphericity represented by Expression (1). In the present exemplary embodiment, the term "spherical shape" refers to a sphericity of 0.6 or higher.

Sphericity=(surface area of a sphere having the same volume as an actual particle)/(surface area of the actual particle). (1)

From the viewpoint of reducing the rubbing force of the magnetic brush by effectively reducing the friction between the fresh carrier particles, the silica particles adhered to the carrier body have a sphericity of preferably 0.8 or higher (or about 0.8 or higher), and more preferably 0.85 or higher.

The volume-average particle diameter of the spherical silica particles is in the range of from 50 nm to 300 nm (or from about 50 nm to about 300 nm), preferably in the range of from 60 nm to 250 nm, and more preferably in the range of from 80 nm to 200 nm. When the volume-average particle diameter of the spherical silica particles is smaller than 50 nm, rolling of the silica particles is inhibited by irregularities on the carrier particles, and control of the rubbing force of the magnetic brush is difficult. When the volume-average particle diameter of the spherical silica particles is greater than 300 nm, the force of adhesion to the carrier particles may be too small, the spherical silica particles may be more likely to detach from the carrier particles, and control of the rubbing force of the magnetic brush may be difficult.

The volume-average particle diameter is a value measured using a laser diffraction-scattering size distribution measuring device (HORIBA LA-910).

The amount of the spherical silica particles adhered to the carrier body particles is in the range of from 0.001 parts by weight to 0.100 parts by weight (or from about 0.001 parts by weight to about 0.100 parts by weight), preferably in the range of from 0.003 parts by weight to 0.080 parts by weight, and more preferably in the range of from 0.005 parts by weight to 0.060 parts by weight, with respect to 100 parts by weight of the carrier body particles. When the amount of adhered silica particles is equal to or greater than 0.001 parts by weight, sufficient reduction of the rubbing force of the magnetic brush may be achieved. When the amount of adhered silica particles is equal to or less than 0.100 parts by weight, an increase in electric resistance of the developer due to adhesion of the spherical silica particles may be suppressed, and a difference between the electric resistance of fresh developer and the electric resistance of deteriorated developer may be hardly generated, as a result of which change in image density may be suppressed.

The particle diameters of the spherical silica particles and the amount of the spherical silica particles adhered to the carrier body particles are controlled by controlling the particle diameters and amount of the spherical silica particles to be mixed (added) with the carrier body particles to produce the carrier particles according to the present exemplary embodiment. The particle diameter and amount of the spherical silica particles in a carrier in which the spherical silica particles have already been adhered to the carrier body particles are measured after detaching the silica particles from the surfaces of the carrier body particles with ultrasonic waves.

Toner

The toner to be mixed with the carrier according to the present exemplary embodiment includes toner mother particles containing a binder resin and a colorant and an external additive (inorganic particles).

Toner Mother Particle

The binder resin of the toner mother particle may be a known resin, and may contain a polyester resin from the viewpoint of fixability at high speed and stress resistance of the toner particles in the development device. A polyester resin can be obtained by condensation polymerization of at least one carboxylic acid component and at least one alcohol component; specifically, at least one bivalent, trivalent, or higher-valent carboxylic acid and at least one dihydric, trihydric, or higher-hydric alcohol are used.

The polyester resin as the binder resin is described in more detail below. Examples of the acid component used in the polyester resin include terephthalic acid, isophthalic acid, orthophthalic acid, and anhydrides thereof. Terephthalic acid/isophthalic acid is preferable. The acid component may be used singly, or in combination of two or more thereof. Any of the above acid components may be used in combination with one or more other acid components (hereinafter referred to as "additional acid component(s)" in some cases). Examples of additional acid components include maleic acid, fumaric acid, citraconic acid, itaconic acid, glutaconic acid, cyclohexanedicarboxylic acid, succinic acid, adipic acid, sebacic acid, azelaic acid, and malonic acid. Further examples include: an alkylsuccinic acid or an alkenylsuccinic acid, such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenyl succinic acid, isododecylsuccinic acid, or isododecenyl succinic acid; an anhydride or lower alkylester of any of the above acids, and a bivalent carboxylic acid other than those described above. In order to cross-link the polyester resin, a trivalent or higher-valent carboxylic acid component may be added and used as an additional acid component. Examples of the trivalent or higher-valent carboxylic acid component include trimellitic acid, pyromellitic acid, 1,2,4-cyclohexanetricarboxylic acid, 2,5,7-naphthalenetricarboxylic acid, 1,2,4-naphthalene tricarboxylic acid, 1,2,5-hexane tricarboxylic acid, 1,2,7,8-octanetetracarboxylic acid, and anhydrides or lower alkylester thereof.

In the polyester resin, for example, a bisphenol A alkylene oxide adduct is used as an alcohol component.

Examples of the bisphenol A alkylene oxide adduct include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane. These compounds may be used singly or in combination of two or more thereof.

In the polyester resin, any of the above alcohol components may be used in combination with one or more other alcohol components (hereinafter referred to as "additional alcohol component(s)" in some cases). Examples of additional alcohol components include: dials such as ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, and 1,6-hexanediol; bisphenol A; hydrogenated bisphenol A; and other dihydric alcohols.

Trihydric or higher-hydric alcohols are also usable as additional alcohol component. Examples of trihydric or higher-hydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and other trihydric or higher-hydric alcohols.

In order to promote the polyester resin synthesis reaction, a commonly-used esterification catalyst may be used in the reaction, such as zinc oxide, stannous oxide, dibutyl tin oxide, or dibutyl tin dilaurate.

The glass-transition temperature Tg of the binder resin may be in the range of from 50° C. to 80° C. (or from about 50° C. to about 80° C.).

The toner mother particle may include a colorant, which may be selected from known pigments and dyes.

Specifically, a colorant of which color corresponds to the desired color of the toner may be selected from the following.

Examples of a colorant used in a cyan toner include: a cyan pigment such as C.I. Pigment Blue 1, C.I. Pigment Blue 2, C.I. Pigment Blue 3, C.I. Pigment Blue 4, C.I. Pigment Blue 5, C.I. Pigment Blue 6, C.I. Pigment Blue 7, C.I. Pigment Blue 10, C.I. Pigment Blue 11, C.I. Pigment Blue 12, C.I. Pigment Blue 13, C.I. Pigment Blue 14, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 15:6, C.I. Pigment Blue 16, C.I. Pigment Blue 17, C.I. Pigment Blue 23, C.I. Pigment Blue 60, C.I. Pigment Blue 65, C.I. Pigment Blue 73, C.I. Pigment Blue 83, C.I. Pigment Blue 180, C.I. Vat Cyan 1, C.I. Vat Cyan 3, C.I. Vat Cyan 20, iron blue, cobalt blue, alkali blue lake, phthalocyanine blue, metal-free phthalocyanine blue, partial chlorinated phthalocyanine blue, first sky blue, or indanthrene blue BC; and a cyan dye such as C.I. Solvent Cyan 79 or 162. Among these, C.I. Pigment Blue 15:3 is preferable.

Examples of a colorant used in a magenta toner include: a magenta pigment such as C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 13, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 39, C.I. Pigment Red 40, C.I. Pigment Red 41, C.I. Pigment Red 48, C.I. Pigment Red 49, C.I. Pigment Red 70, C.I. Pigment Red 51, C.I. Pigment Red 52, C.I. Pigment Red 53, C.I. Pigment Red 54, C.I. Pigment Red 55, C.I. Pigment Red 57, C.I. Pigment Red 58, C.I. Pigment Red 60, C.I. Pigment Red 63, C.I. Pigment Red 64, C.I. Pigment Red 68, C.I. Pigment Red 81, C.I. Pigment Red 83, C.I. Pigment Red 87, C.I. Pigment Red 88, C.I. Pigment Red 89, C.I. Pigment Red 90, C.I. Pigment Red 112, C.I. Pigment Red 114, C.I. Pigment Red 122, C.I. Pigment Red 123, C.I. Pigment Red 163, C.I. Pigment Red 184, C.I. Pigment Red 185, C.I. Pigment Red 202, C.I. Pigment Red 206, C.I. Pigment Red 207, C.I. Pigment Red 209, C.I. Pigment Red 238, or C.I. Pigment Violet 19; a magenta dye such as C.I. Solvent Red 1, C.I. Solvent Red 3, C.I. Solvent Red 8, C.I. Solvent Red 23, C.I. Solvent Red 24, C.I. Solvent Red 25, C.I. Solvent Red 27, C.I. Solvent Red 30, C.I. Solvent Red 49, C.I. Solvent Red 81, C.I. Solvent Red 82, C.I. Solvent Red 83, C.I. Solvent Red 84, C.I. Solvent Red 100, C.I. Solvent Red 109, C.I. Solvent Red 121, C.I. Disperse Red 9, C.I. Basic Red 1, C.I. Basic Red 2, C.I. Basic Red 9, C.I. Basic Red 12, C.I. Basic Red 13, C.I. Basic Red 14, C.I. Basic Red 15, C.I. Basic Red 17, C.I. Basic Red 18, C.I. Basic Red 22, C.I. Basic Red 23, C.I. Basic Red 24, C.I. Basic Red 27, C.I. Basic Red 29, C.I. Basic Red 32, C.I. Basic Red 34, C.I. Basic Red 35, C.I. Basic Red 36, C.I. Basic Red 37, C.I. Basic Red 38, C.I. Basic Red 39, or C.I. Basic Red 40; red iron oxide; cadmium red; red lead; mercury sulfide; cadmium; permanent Red 4R; lithol red; pyrazolone red; watchung red; calcium salt; lake red D; brilliant carmine 6B; eosin lake; rhodamine lake B; alizarin lake; and brilliant carmine 3B.

Examples of a colorant used in a yellow toner include: a yellow pigment such as C.I. Pigment Yellow 2, C.I. Pigment Yellow 3, C.I. Pigment Yellow 15, C.I. Pigment Yellow 16, C.I. Pigment Yellow 17, C.I. Pigment Yellow 74, C.I. Pigment Yellow 93, C.I. Pigment Yellow 97, C.I. Pigment Yellow 128, C.I. Pigment Yellow 155, C.I. Pigment Yellow 180, C.I. Pigment Yellow 185, or C.I. Pigment Yellow 139.

Examples of a colorant used in a black toner include carbon black, activated carbon, titanium black, magnetic powder, and Mn-containing nonmagnetic powder. Pigments selected from yellow, magenta, cyan, red, green, and blue pigments may be mixed to form a black toner.

The addition amount of colorant may be such that the content of colorant in the final toner produced by mixing with a binder resin and the like is in the range of from 1% by weight to 20% by weight relative to the final toner.

A wax and/or a charge control agent may be added to the toner as needed.

Examples of the wax include: an unsaturated fatty acid such as ester wax, polyethylene, polypropylene or copolymer of polyethylene and polypropylene, polyglycerine wax, microcrystalline wax, paraffin wax, carnauba wax, sasol wax, montanic ester wax, deacidified carnauba wax, palmitic acid, stearic acid, montanic acid, brassidic acid, eleostearic acid, or parinaric acid; a saturated alcohol such as stearyl alcohol, aralkyl alcohol, behenylalcohol, carnaubyl alcohol, ceryl alcohol, melissyl alcohol, or a long-chain alkyl alcohol having a still longer alkyl group; a polyhydric alcohol such as sorbitol; a fatty acid amide such as linoleamide, oleamide, or lauramide; a saturated fatty acid bisamide such as methylene bis stearamide, ethylene bis capramide, ethylene bis lauramide, or hexamethylene bis stearamide; an unsaturated fatty acid amide such as ethylene bis oleamide, hexamethylene bis oleamide, N,N'-dioleyl adipamide, or N,N'-dioleyl sebacamide; an aromatic bisamide such as m-xylene bis stearamide or N,N'-distearyl isophthalamide; a fatty acid metal salt (generally referred to as metal soap) such as calcium stearate, calcium laurate, zinc stearate, or magnesium stearate; a graft wax obtained by reaction of a vinyl monomer such as styrene or acrylic acid with an aliphatic hydrocarbon wax; a partially-esterified compound of a fatty acid and a polyhydric alcohol such as behenic monoglyceride; and a methylester compound having a hydroxyl group and obtained by hydrogenation of a vegetable oil.

A wax material having an endothermic peak in the range of from 50° C. to 200° C. (or from about 50° C. to about 200° C.) in differential scanning calorimetry (DSC) is preferable as the wax. When the temperature at the peak is lower than 50° C., toner blocking may occur. When the temperature at the peak is higher than 200° C., the wax material does not contribute to improvement of fixability in some cases.

In regard to the measuring principle of the DSC measurement, the DSC measurement may be performed using a high-precision internal-heat power compensation differential scanning calorimeter, and is performed at a temperature increase rate of 10° C./min starting from room temperature (25° C.).

The content of wax is preferably in the range of from 0.5% by weight to 10% by weight (or from about 0.5% by weight to about 10% by weight), and more preferably in the range of from 1% by weight to 8% by weight, relative to the amount of the entire toner particles.

Examples of the charge control agent include known calixarene, nigrosine dyes, quaternary ammonium salts, amino group-containing polymers, metal-containing azo dyes, complex compounds of salicylic acid, phenol compounds, azo chrome charge control agents, and azo zinc charge control agents.

A magnetic material such as iron powder, magnetite, or ferrite may be incorporated into the toner to form a magnetic toner. Specifically, a known white magnetic powder (for example, a product manufactured by Nittetsu Mining Co., Ltd.) may be used in the case of a color toner.

External Additive

In the toner according to the present exemplary embodiment, inorganic particles may be used as an external additive. The inorganic particles may include silica particles of which the surfaces have been treated with a silane coupling agent having an amino group so that each silica particle has a treatment layer containing a silane coupling agent on the surface thereof. Using the silica particles imparts excellent positively-charging properties and excellent powder fluidity to the toner.

The volume-average particle diameter of the silica particles each having the treatment layer containing a silane coupling agent on the surface thereof is preferably equal to or greater than 5 nm from the viewpoint of suppression of change in external additive structure due to stress, and is preferably equal to or less than 40 nm from viewpoint of imparting fluidity to the toner.

The addition amount of silica particles each having the treatment layer containing a silane coupling agent on the surface thereof is preferably in the range of from 0.01% by weight to 5% by weight, and more preferably in the range of from 0.1% by weight to 3.0% by weight, with respect to the amount of toner particles excluding the external additives.

The silica particles of which the surfaces have been treated with a silane coupling agent containing an amino group exhibit a strong force of adhesion to an image holder. Therefore, the silica particles of this kind have higher tendency to cause band-like image density unevenness due to adhesion to the image holder, particularly when the image holder is an amorphous silicon image holder.

However, when the rubbing properties of the magnetic brush are appropriately controlled by using a developer in which a toner containing the external additive and the carrier according to the present exemplary embodiment are mixed, generation of band-like image density unevenness is suppressed, and excellent image quality is obtained, even when silica particles treated with a silane coupling agent containing an amino group are used.

Examples of the silane coupling agent containing an amino group include 3-aminopropyltrimethoxysilane, 3-aminopropyltriethoxysilane, N-(2-amino ethyl)-3-aminopropylmethyldimethoxysilane, N-(2-aminoethyl)-3-aminopropyltrimethoxysilane, N-2-(amino ethyl)-3-aminopropyltriethoxysilane, and N-phenyl-3-aminopropyltrimethoxysilane.

Known inorganic particles and/or organic particles may be used as an external additive other than the silica described above, in addition to or in place of the silica.

Examples of inorganic particles other than silica particles include particles of any of the following: alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Examples of organic particles include particles of any of the following: vinyl polymers such as styrene polymer, (meth)acrylic polymer, and ethylene polymer; various polymers such as ester polymers, melamine polymers, amide polymers, and aryl phthalate polymers; fluoro polymers such as fluorinated vinylidene; and metal salts of higher fatty acids, a typical example of which is zinc stearate.

The above external additives may be sufficiently mixed by a mixer such as a HENSCHEL (trademark) mixer and then externally added.

The toner according to the present exemplary embodiment may be produced by a known production method such as a kneading and pulverizing method, a suspension polymerization method, an emulsification flocculation method, or a dissolution-suspension method.

The toner according to the present exemplary embodiment may be suitably used in an image forming apparatus in which an amorphous silicon image holder, from which external additive is hard to remove due to the smallness of abrasion amount of the image holder, is used. The toner may be suitably used also in an image forming apparatus which has a mechanism for heating a surface of the image holder and in which adhesion of toner to the image holder is enhanced.

Developer

The developer according to the present exemplary embodiment can be obtained by mixing a toner with the carrier particles, in which the spherical silica particles have been adhered to the surfaces of the carrier body particles by mixing the spherical silica particles and the carrier bodies in advance.

The content of toner in the developer is preferably in the range of from 2.0 parts by weight to 20 parts by weight, more preferably in the range of from 2.5 parts by weight to 16 parts by weight, and still more preferably in the range of from 3.0 parts by weight to 14 parts by weight, with respect to 100 parts by weight of the developer.

Image Forming Apparatus

The image forming apparatus according to the present exemplary embodiment includes an image holder, an electrostatic image forming unit that forms an electrostatic image on a surface of the image holder, a development unit that develops the electrostatic image formed on the surface of the image holder using the electrostatic image developer according to the present exemplary embodiment to form a toner image, a transfer unit that transfers the toner image formed on the surface of the image holder to a transfer receiver, a fixing unit that fixes the toner image on the transfer receiver, and a toner removal unit that removes toner remaining on the image holder after the toner image has been transferred to the transfer receiver.

Since the amorphous silicon image holder has excellent abrasion resistance, the amorphous silicone image holder has an extended lifetime. However, if an external additive adheres to the surface of the image holder, the adhered matter is less likely to be removed due to an extremely small abrasion amount of the surface layer of the image holder, as a result of which band-like image density unevenness may occur frequently. However, use of the developer according to the present exemplary embodiment may effectively suppress the generation of band-like image density unevenness.

The developer according to the present exemplary embodiment may be suitably applied to an image forming apparatus in which the development unit includes a developer holder that holds the electrostatic image developer and operates at a circumferential speed of 1,000 mm/s or higher (or about 1,000 mm/s or higher), and in which the movement direction of the developer holder and the movement direction of the image holder is opposite to each other at a position at which the developer holder and the image holder are closest to each other. In the image forming apparatus performing the against development as described above, the magnetic brush rubs the image holder at high speed, and the influence of rubbing by the magnetic brush is great compared with a case in which the movement direction of the developer holder and the movement direction of the image holder is the same at a position at which the developer holder and the image holder are closest to each other. However, generation of band-like image density unevenness may be effectively suppressed by using the developer according to the present exemplary embodiment.

Figure 2:
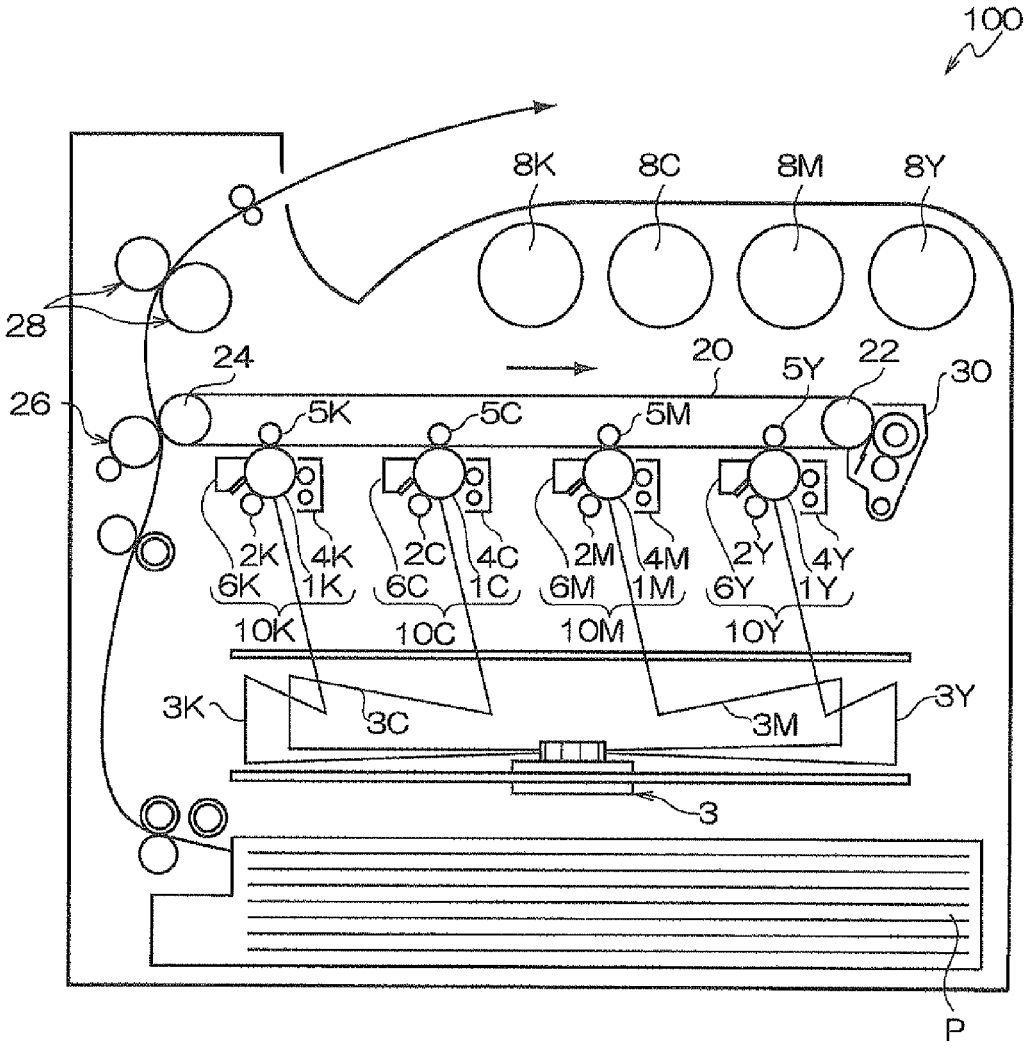
FIG. 2 is a diagram schematically illustrating an example of an image forming apparatus according to an exemplary embodiment of the invention.

An image forming apparatus according to the present exemplary embodiment will be described specifically. FIG. 2 schematically illustrates an example of the configuration of the image forming apparatus according to the present exemplary embodiment.

An image forming apparatus 100 is a 4-drum tandem color image forming apparatus. The image forming apparatus 100 includes first, second, third, and fourth electrophotographic image forming units 10Y, 10M, 10C, 10K (image forming devices), respectively, which output images for the colors of yellow (Y), magenta (M), cyan (C), and black (K), respectively, based on color-separated image data. The image forming units (hereinafter simply referred to as "units") 10Y, 10M, 10C, and 10K are arranged with a predetermined distance therebetween in the horizontal direction. The units 10Y, 10M, 10C, and 10K may be process cartridges which are attachable to and detachable from the image forming apparatus body.

An intermediate transfer belt 20 as an intermediate transfer member is provided above the units 10Y, 10M, 10C, and 10K so as to extend through the units. The intermediate transfer belt 20 is wound on a driving roller 22 and a support roller 24 that contacts the inner surface of the intermediate transfer belt 20, and the driving roller 22 and the support roller 24 are separated from each other in the direction from right to left in FIG. 2. The intermediate transfer belt 20 is capable of being rotated in the direction from the first unit 10Y to the fourth unit 10K. The support roller 24 is urged in a direction farther from the driving roller 22 by a spring or the like not shown in the drawing, so that a predetermined tension is provided to the intermediate transfer belt 20 wound on both rollers. An intermediate transfer member cleaning device 30 is disposed at the outer circumferential surface of the intermediate transfer belt 20 so as to face the driving roller 22.

The development devices (development units) 4Y, 4M, 4C, and 4K of the units 10Y, 10M, 10C, and 10K are respectively supplied with toners of four colors of yellow, magenta, cyan, and black accommodated in the toner cartridges 8Y, 8M, 8C, and 8K, respectively.

The first, second, third, and fourth units 10Y, 10M, 10C, and 10K have the same configuration, and only the first unit 10Y that forms a yellow image and that is disposed at the upstream side with respect to the rotation direction of the intermediate transfer belt is described below as a representative unit. Elements in the units 10M, 10C, and 10K that are equivalent to elements in the first unit 10Y are designated by the same reference numerals as those in the unit 10Y, but M (magenta), C (cyan), and K (black), respectively, are suffixed thereto in place of Y (yellow), and explanations of the second, third, and fourth units 10M, 10C, and 10K are omitted.

The first unit 10Y includes an image holder 1Y serving as an image holder. A charging roller 2Y that charges a surface of the image holder 1Y to a predetermined potential, an exposure device 3 that exposes the charged surface to a laser beam 3Y based on a color-separated image signal so as to form an electrostatic image, a development device (development unit) 4Y that supplies a charged toner to the electrostatic image so as to develop the electrostatic image, a primary transfer roller (primary transfer unit) 5Y that transfers the developed toner image onto the intermediate transfer belt 20, and an image holder cleaning device (residual toner removal unit) 6Y that removes, with a cleaning blade, toner remaining on the surface of the image holder 1Y after the primary transfer, are sequentially arranged around the image holder 1Y.

The primary transfer roller 5Y is disposed inside the intermediate transfer roller 20, and is disposed at a position facing the image holder 1Y. Bias power sources (not shown) that apply primary transfer biases are respectively connected to the primary transfer rollers 5Y, 5M, 5C, and 5K. The bias power sources change the transfer biases applied to the primary transfer rollers according to control by a controller (not shown in the drawing).

The operation of forming a yellow image in the first unit 10Y is described below. First, before the operation, a surface of the image holder 1Y is charged by the charging roller 2Y.

The surface of the charged image holder 1Y is irradiated with the laser beam 3Y emitted from the exposure device 3 in accordance with image data for yellow sent from the controller (not shown in the drawing). Specifically, a photoconductive layer at the surface of the image holder 1Y is irradiated with the laser beam 3Y, whereby an electrostatic image of a yellow print pattern is formed on the surface of the image holder 1Y.

The electrostatic image formed on the image holder 1Y is conveyed to a predetermined development position by the rotation of the image holder 1Y. At the development position, the electrostatic image on the image holder 1Y is visualized as a toner image by the development device 4Y.

The carrier according to the present exemplary embodiment and a yellow toner are accommodated in the development device 4Y. As shown in FIG. 1, on the surface of the development roller (developer holder) 14, the carrier forms the magnetic brush 13 extending toward the image holder 1Y such that the magnetic brush 13 rubs the surface of the image holder 1Y. The yellow toner acquires triboelectricity by being agitated inside the development device 4Y, and is held on the development roller 14 in the state in which the yellow toner has a charge having the same polarity as the charging polarity of the surface of the image holder 1Y.

As the surface of the image holder 1Y passes through the development device 4Y, the yellow toner is electrostatically attached, via the magnetic brush, to the diselectrified image region on the surface of the image holder 1Y, whereby the image is developed with the yellow toner. The image holder 1Y having a yellow toner image formed thereon continues to be rotated at a predetermined speed and the toner image developed on the image holder 1Y is conveyed to a predetermined primary transfer position.

When the yellow toner image on the image holder 1Y has been conveyed to the primary transfer position, a predetermined primary transfer bias is applied to the primary transfer roller 5Y, and an electrostatic force in the direction from the image holder 1Y towards the primary transfer roller 5Y acts on the toner image, whereby the toner image on the image holder 1Y is transferred to the intermediate transfer belt 20. The transfer bias applied at this time has a polarity opposite to that of the charge of the toner.

After the transfer, residual toner on the image holder 1Y is removed and collected by the cleaning device 6Y.

The primary transfer biases applied to the primary transfer rollers 5M, 5C, and 5K of the second, third, and fourth unit 10M, 10C, and 10K are controlled in the same manner as in the case of the first unit.

The intermediate transfer belt 20 onto which the yellow toner image has thus been transferred in the first unit 10Y is sequentially conveyed through the second, third, and fourth units 10M, 10C, and 10K, during which toner images of the respective colors are transferred one on another.

The intermediate transfer belt 20 onto which toner images of four colors have been transferred one on another by the first to fourth units reaches a secondary transfer unit composed of the intermediate transfer belt 20, the support roller 24 contacting the inner face of the intermediate transfer belt 20, and a secondary transfer roller (secondary transfer member) 26 disposed on the image holding side of the intermediate transfer belt 20. A recording medium P is fed to a region between the secondary transfer roller 26 and the intermediate belt 20, which are in pressure contact with each other at the region, at a predetermined timing by a feed mechanism, and a predetermined secondary transfer bias is applied to the support roller 24. The transfer bias applied at this time has the same polarity as the polarity of the charge of the toner, whereby an electrostatic force in the direction from the intermediate transfer belt 20 to the recording sheet P acts on the toner image, and the toner image on the intermediate transfer belt 20 is transferred onto the recording sheet P. The secondary transfer bias is determined in accordance with the electric resistance detected by a resistance detector (not shown) that detects the electric resistance of the secondary transfer unit, and is voltage-controlled.

Thereafter, the recording medium P is conveyed to a fixing device (fixing unit) 28, at which the toner image is heated, whereby superposed color toner images are fused and fixed to the recording medium P. The recording medium P onto which the color image has been fixed is conveyed to a discharge unit, which is completion of a series of color image forming operations.

Although the image forming apparatus illustrated above has a configuration in which a toner image is transferred to the recording medium P via the intermediate transfer belt 20, configurations of the image forming apparatus are not limited to thereto. The apparatus may have a structure in which a toner image is directly transferred from the image holder to the recording sheet.

Toner Cartridge and Process Cartridge

The toner cartridge according to the present exemplary embodiment accommodates the electrostatic image developer according to the present exemplary embodiment, and is attached to and detached from an image forming apparatus.

The process cartridge according to the present exemplary embodiment is attached to and detached from an image forming apparatus body, and includes an image holder, a development unit that develops an electrostatic image formed on a surface of the image holder using the above-described electrostatic image developer to form a toner image, and a toner removal unit that removes residual toner on the image holder after the toner image has been transferred to a transfer receiver.

Figure 3:
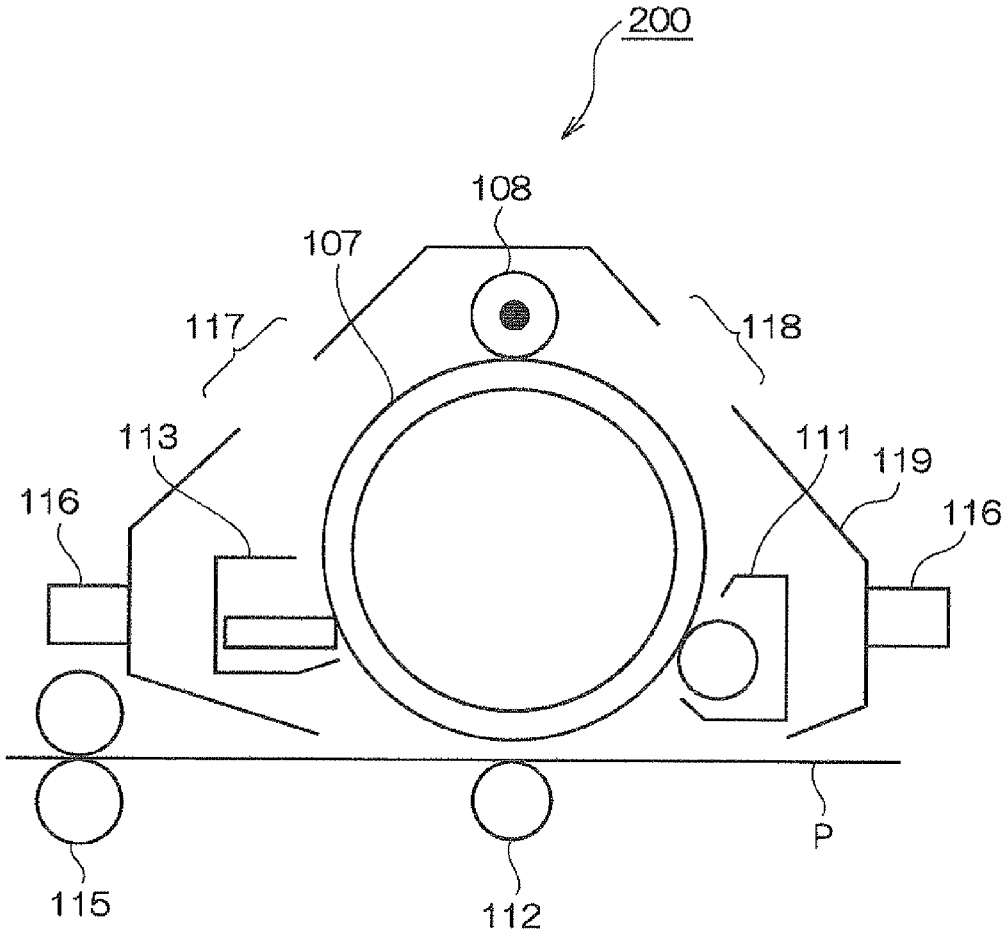
FIG. 3 is a diagram schematically illustrating an example of a process cartridge according to an exemplary embodiment of the invention.

FIG. 3 is a diagram schematically illustrating an example of the configuration of a process cartridge according to the present exemplary embodiment. A process cartridge 200 shown in FIG. 3 is a cartridge in which a unit including an image holder 107 of which the surface is formed of amorphous silicon, a charging roller 108, a development device 111, and an image holder cleaning device (cleaning unit) 113 is combined with a case 119 having an opening 118 for exposure, an opening 117 for diselectrification exposure, and an attachment rail 116 so that the respective elements are integrated.

The process cartridge 200 is attachable to and detachable from an image forming apparatus body including a transfer device 112, a fixing device 115, and other elements (not shown in the drawing), and forms an image forming apparatus together with the image forming apparatus body. Here, P represents a recording medium.

The process cartridge 200 shown in FIG. 3 includes the image holder 107, the charging device 108, the development device 111, and the cleaning device (cleaning unit) 113. However, devices to be included in the process cartridge may be arbitrarily selected from these devices, and combined. For example, the process cartridge according to the present exemplary embodiment may include the development device 111 and at least one selected from the image holder 107, the charging device 108, or the cleaning device (cleaning unit) 113.

In any of the image forming apparatus, the toner cartridge, and the process cartridge, use of the developer according to the exemplary embodiment may reduce the rubbing force of the magnetic brush against the image holder, and both of suppression of change in image density and suppression of generation of band-like image density unevenness may be compatibly achieved.

EXAMPLES

Examples of the invention are described below.

Example 1

Preparation of Spherical Silica Particles A-1

A silica sol obtained by a sol-gel method is subjected to a treatment with hexamethyldisilazane (HMDS), followed by drying and pulverization, as a result of which spherical silica particles A-1 having a sphericity of $\psi$=0.88 and a volume average particle diameter of 130 nm are obtained.

In Examples, the volume average particle diameter of silica particles is measured using a laser diffraction-scattering particle size distribution measurement apparatus (HORIBA LA-910), and the sphericity was obtained by the above-described expression (1) that defines a Wadell's true sphericity.

The surface area of a sphere having the same volume as that of an actual particle is obtained by calculation based on an average particle diameter. The surface area of the actual particle diameter is obtained from a BET specific surface area measured using a Shimadzu powder specific surface area measurement apparatus SS-100 (tradename, manufactured by Shimadzu Corporation).

Preparation of Silica Particles B-1 Treated having Silane Coupling Agent Containing Amino Group While agitating gas-phase method silica particles having a BET specific surface area of 200 $m^2/g$ (trade name, AEROSIL 200 manufactured by Nippon Aerosil Co., Ltd.) under a nitrogen atmosphere, N-(2-aminoethyl)-3-aminopropyltrimethoxysilane (trade name, KBM-603 manufactured by Shin-Etsu Chemical Co., Ltd.) is dropwise added thereto, and the mixture is heated, blended, and agitated at 150° C. for 90 minutes to remove volatile components. Thereafter, the resultant is then cooled, as a result of which aminosilane-treated silica particles B-1 are obtained. The volume average particle diameter of the silica particles B-1 is 12 nm.

Preparation of Toner Particles 1

87.0 parts by weight of polyester resin 1 (polyester resin of which main components are propylene oxide/ethylene oxide adduct of bisphenol A, terephthalic acid, and trimellitic acid)

8.0 parts by weight of carbon black (trade name, REGAL330, manufactured by CABOT JAPAN K.K.)

4.0 parts by weight of paraffin wax (trade name, HNP9 manufactured by NIPPON SEIRO Co., Ltd.)

1.0 parts by weight of a charge control agent (trade name, BONTRON N-01 manufactured by ORIENT CHEMICAL INDUSTRIES Co., Ltd.)

The above substances are powder-blended by a Henschel mixer, the resultant is thermally kneaded by an extruder at a set temperature of 100° C., and the resultant is cooled, coarsely pulverized, finely pulverized, and classified, as a result of which toner mother particles 1 having a volume average particle diameter D50 of 7.8 μm are obtained.

Further, 100 parts by weight of the toner mother particles 1 and 1.1 parts by weight of the silica particles B-1 are blended by a Henschel mixer, as a result of which toner particles 1 are obtained.

Preparation of Carrier Particles 1

200 g (as solid weight) of dimethyl silicone resin containing a trifluoropropyl group (trade name, SR-2410 manufactured by Toray Dow Corning Corporation) is weighed out, and is dissolved in 1,000 cc of toluene solvent. Then, conductive carbon black (trade name, VULCAN XC72, manufactured by CABOT JAPAN K.K.) in an amount of 15 weight % relative to the amount of the solid of the resin and 2 g of an organic aluminum curing catalyst (aluminum-di-n-butoxide-mono-ethyl acetoacetate) are added thereto, and the resultant is dispersed by a pearl mill, as a result of which an inner layer formation solution is obtained.

Suitable amounts of raw materials are mixed to provide 30 mol % of MnO, 9.5 mol % of MgO, 60 mol % of $Fe_2O_3$, and 0.5 mol % of SrO, and water is added thereto. The resultant is pulverized and blended in a wet ball mill for 10 hours, and then dried. The resultant is left to stand at 900° C. for 4 hours, and thereafter subjected to pulverization in a wet ball mill for 24 hours. The slurry obtained is granulated and dried, and the resultant particles are left to stand at 1250° C. for 6 hours in an atmosphere having an oxygen concentration of 2%. Subsequently, the particles are crushed to control the particle size, as a result of which manganese-magnesium-strontium ferrite particles 1 are obtained.

The inner layer formation solution in which the carbon black is dispersed is applied, in an amount of 2.2 parts by weight in terms of the amount of the solid of the silicone resin, to 100 parts by weight of the manganese-magnesium-strontium ferrite particles 1 using a fluidized bed (spray dry) coating apparatus, and the resultant is dried at 100° C., thereby forming an inner resin layer.

Separately, a surface layer formation solution is prepared in the same manner as the preparation of the inner layer formation solution, except that the amount of the carbon black is changed to 0.10 weight % relative to the amount of the solid of the resin. The surface layer formation solution is applied using a fluidized bed as a coating apparatus, thereby forming a surface layer on the inner resin layer. The amount of the surface layer formation solution applied is such that the amount of the solid of the silicone resin in the surface layer becomes 0.5 parts by weight. Thereafter, the particles are dried at 100° C., and are then baked at 270° C. for 1 hour. Then, the particles are subjected to a crushing treatment, and to a post-process using a vibration mill for 30 minutes, as a result of which carrier body particles 1 are obtained.

The volume average particle diameter of the carrier body particles 1 is 50 μm.

The surface roughness Ra of the carrier body particles 1 is measured and found to be 1.1 μm.

Here, the surface roughness Ra is the average value of measurement values of 100 carrier body particles as measured by a laser microscope (trade name, VK-9500 manufactured by KEYENCE Corporation).

100 parts by weight of the carrier body particles 1 and 0.030 parts by weight of the spherical silica particles A-1 are blended by a V blender, as a result of which carrier particles in which the spherical silica particles A-1 are adhered to the surfaces of the carrier body particles are obtained.

Preparation of Developer 1

95 parts by weight of the carrier particles obtained as described above and 5 parts by weight of the toner particles 1 are blended by a V blender, thereby providing a developer 1.

Example 2

A developer 2 is obtained in the same manner as in Example 1, except that the amount of the spherical silica particles A-1 added is changed to 0.001 parts by weight.

Example 3

A developer 3 is obtained in the same manner as in Example 1, except that the amount of the spherical silica particles A-1 added is changed to 0.100 parts by weight.

Comparative Example 1

A developer 4 is obtained in the same manner as in Example 1, except that the carrier body particles 1 and the toner particles 1 are blended without the addition of the spherical silica particles A-1.

Comparative Example 2

A developer 5 is obtained in the same manner as in Example 1, except that the amount of the spherical silica particles A-1 added is changed to 0.140 parts by weight.

Example 4

A developer 6 is obtained in the same manner as in Example 1, except that the amount of the spherical silica particles A-1 added is changed to 0.080 parts by weight.

Example 5

Preparation of Spherical Silica Particles A-2

A silica sol obtained by a sol-gel method is subjected to a treatment with hexamethyldisilazane (HMDS), followed by drying and pulverization, as a result of which spherical silica particles A-2 having a sphericity of $\psi$=0.90 and a volume average particle diameter of 50 nm are obtained.

Preparation of Carrier Body Particles 2

200 g (as solid weight) of dimethyl silicone resin containing a trifluoropropyl group (trade name, SR-2410 manufactured by Toray Dow Corning Corporation) is weighed out, and is dissolved in 1,000 cc of toluene solvent. Then, conductive carbon black (trade name, VULCAN XC72, manufactured by CABOT JAPAN K.K.) in an amount of 15 weight % relative to the amount of the solid of the resin and 2 g of an organic aluminum curing catalyst (aluminum-di-n-butoxide-mono-ethyl acetoacetate) are added thereto, and the resultant is dispersed by a pearl mill, as a result of which an inner layer formation solution is obtained.

Suitable amounts of raw materials are mixed to provide 30 mol % of MnO, 9.5 mol % of MgO, 60 mol % of $Fe_2O_3$, and 0.5 mol % of SrO, and water is added thereto. The resultant is pulverized and blended in a wet ball mill for 10 hours, and then dried. The resultant is left to stand at 900° C. for 4 hours, and thereafter subjected to pulverization in a wet ball mill for 24 hours. The slurry obtained is granulated and dried, and the resultant particles are left to stand at 1300° C. for 6 hours in an atmosphere having an oxygen concentration of 2%. Subsequently, the particles are crushed to control the particle size, as a result of which manganese-magnesium-strontium ferrite particles 2 are obtained.

The inner layer formation solution in which the carbon black is dispersed is applied, in an amount of 2.2 parts by weight in terms of the amount of the solid of the silicone resin, to 100 parts by weight of the manganese-magnesium-strontium ferrite particles 2 using a fluidized bed (spray dry) coating apparatus, and the resultant is dried at 100° C., thereby forming an inner resin layer.

Separately, a surface layer formation solution is prepared in the same manner as the preparation of the inner layer formation solution in Example 5, except that the amount of the carbon black is changed to 0.10 weight % relative to the amount of the solid of the resin. The surface layer formation solution is applied using a fluidized bed as a coating apparatus, thereby forming a surface layer on the inner resin layer. The amount of the surface layer formation solution applied is such that the amount of the solid of the silicone resin in the surface layer becomes 0.5 parts by weight. Thereafter, the particles are dried at 100° C. and are then baked at 270° C. for 1 hour. Then, the particles are subjected to a crushing treatment, and to a post-process using a vibration mill for 30 minutes, as a result of which carrier body particles 2 are obtained.

The volume average particle diameter of the carrier body particles 2 is 45 μm.

The surface roughness Ra of the carrier body particles 2 is measured and found to be 0.8 μm.

100 parts by weight of the carrier body particles 2 and 0.025 parts by weight of the spherical silica particles A-2 are blended by a V blender, as a result of which carrier particles in which the spherical silica particles A-2 are adhered to the surfaces of the carrier body particles are obtained.

95 parts by weight of the carrier particles obtained and 5 parts by weight of the toner particles 1 are blended by a V blender, thereby providing a developer 7.

Example 6

A developer 8 is obtained in the same manner as in Example 5, except that the amount of the spherical silica particles A-2 added is changed to 0.005 parts by weight.

Example 7

Preparation of Spherical Silica Particles A-3

A silica sol obtained by a sol-gel method is subjected to a treatment with hexamethyldisilazane (HMDS), followed by drying and pulverization, as a result of which spherical silica particles A-3 having a sphericity of $\psi$=0.80 and a volume average particle diameter of 80 nm are obtained.

Preparation of Carrier Body Particles 3

200 g (as solid weight) of dimethyl silicone resin containing a trifluoropropyl group (trade name, SR-2410 manufactured by Toray Dow Corning Corporation) is weighed out, and is dissolved in 1,000 cc of toluene solvent. Then, conductive carbon black (trade name, VULCAN XC72, manufactured by CABOT JAPAN K.K.) in an amount of 15 weight % relative to the amount of the solid of the resin and 2 g of an organic aluminum curing catalyst (aluminum-di-n-butoxide-mono-ethyl acetoacetate) are added thereto, and the resultant is dispersed by a pearl mill, as a result of which an inner layer formation solution is obtained.

Suitable amounts of raw materials are mixed to provide 30 mol % of MnO, 9.5 mol % of MgO, 60 mol % of $Fe_2O_3$, and 0.5 mol % of SrO, and water is added thereto. The resultant is pulverized and blended in a wet ball mill for 10 hours, and then dried. The resultant is left to stand at 900° C. for 4 hours, and thereafter subjected to pulverization in a wet ball mill for 24 hours. The slurry obtained is granulated and dried, and the resultant particles are left to stand at 1200° C. for 5 hours in an atmosphere having an oxygen concentration of 2%. Subsequently, the particles are crushed to control the particle size, as a result of which manganese-magnesium-strontium ferrite particles 3 are obtained.

The inner layer formation solution in which the carbon black is dispersed is applied, in an amount of 2.2 parts by weight in terms of the amount of the solid of the silicone resin, to 100 parts by weight of the manganese-magnesium-strontium ferrite particles 3 using a fluidized bed (spray dry) coating apparatus, and the resultant is dried at 100° C., thereby forming an inner resin layer.

Separately, a surface layer formation solution is prepared in the same manner as the preparation of the inner layer formation solution in Example 7, except that the amount of the carbon black is changed to 0.10 weight % relative to the amount of the solid of the resin. The surface layer formation solution is applied using a fluidized bed as a coating apparatus, thereby forming a surface layer on the inner resin layer. The amount of the surface layer formation solution applied is such that the amount of the solid of the silicone resin in the surface layer becomes 0.5 parts by weight. Thereafter, the particles are dried at 100° C. and are then baked at 270° C. for 1 hour. Then, the particles are subjected to a crushing treatment, and to a post-process using a vibration mill for 30 minutes, as a result of which carrier body particles 3 are obtained.

The volume average particle diameter of the carrier body particles 3 is 60 μm.

The surface roughness Ra of the carrier body particles 3 is measured and found to be 2.0 μm.

100 parts by weight of the carrier body particles 3 and 0.020 parts by weight of the spherical silica particles A-3 are blended by a V blender, as a result of which carrier particles in which the spherical silica particles A-3 are adhered to the surfaces of the carrier body particles are obtained.

95 parts by weight of the carrier particles obtained and 5 parts by weight of the toner particles 1 are blended by a V blender, thereby providing a developer 9.

Example 8

A developer 10 is obtained in the same manner as in Example 7, except that the amount of the spherical silica particles A-3 added is changed to 0.080 parts by weight.

Example 9

Preparation of Spherical Silica Particles A-4

Silica sol obtained by a sol-gel method is subjected to a hexamethyldisilazane (HMDS) process, drying, and pulverization, as a result of which spherical silica particles A-4 having a sphericity of $\psi$=0.85 and a volume average particle diameter of 200 nm are obtained.

100 parts by weight of the carrier body particles 3 obtained in Example 7 and 0.040 parts by weight of the spherical silica particles A-4 are blended by a V blender, as a result of which carrier particles in which the spherical silica particles A-4 are adhered to the surfaces of the carrier body particles are obtained.

95 parts by weight of the carrier particles obtained and 5 parts by weight of the toner particles 1 are blended by a V blender, thereby providing a developer 11.

Example 10

Preparation of Carrier Body Particles 4

200 g (as solid weight) of dimethyl silicone resin containing a trifluoropropyl group (trade name, SR-2410 manufactured by Toray Dow Corning Corporation) is weighed out, and is dissolved in 1,000 cc of toluene solvent. Then, conductive carbon black (trade name, VULCAN XC72, manufactured by CABOT JAPAN K.K.) in an amount of 15 weight % relative to the amount of the solid of the resin and 2 g of an organic aluminum curing catalyst (aluminum-di-n-butoxide-mono-ethyl acetoacetate) are added thereto, and the resultant is dispersed by a pearl mill, as a result of which an inner layer formation solution is obtained.

Suitable amounts of raw materials are mixed to provide 30 mol % of MnO, 9.5 mol % of MgO, 60 mol % of $Fe_2O_3$, and 0.5 mol % of SrO, and water is added thereto. The resultant is pulverized and blended in a wet ball mill for 10 hours, and then dried. The resultant is left to stand at 1000° C. for 4 hours, and thereafter subjected to pulverization in a wet ball mill for 24 hours. The slurry obtained is granulated and dried, and the resultant particles are left to stand at 1300° C. for 8 hours in an atmosphere having an oxygen concentration of 2%. Subsequently, the particles are crushed to control the particle size, as a result of which manganese-magnesium-strontium ferrite particles 4 are obtained.

The inner layer formation solution in which the carbon black is dispersed is applied, in an amount of 1.8 parts by weight in terms of the amount of the solid of the silicone resin, to 100 parts by weight of the manganese-magnesium-strontium ferrite particles 4 using a fluidized bed (spray dry) coating apparatus, and the resultant is dried at 100° C., thereby forming an inner resin layer.

Separately, a surface layer formation solution is prepared in the same manner as the preparation of the inner layer formation solution in Example 10, except that the amount of the carbon black is changed to 0.05 weight % relative to the amount of the solid of the resin. The surface layer formation solution is applied using a fluidized bed as a coating apparatus, thereby forming a surface layer on the inner resin layer. The amount of the surface layer formation solution applied is such that the amount of the solid of the silicone resin in the surface layer becomes 0.6 parts by weight. Thereafter, the particles are dried at 100° C. and are then baked at 270° C. for 1 hour. Then, the particles are subjected to a crushing treatment, and to a post-process using a vibration type mill for 30 minutes, as a result of which carrier body particles 4 are obtained.

The volume average particle diameter of the carrier body particles 4 is 50 μm.

The surface roughness Ra of the carrier body particles 4 is measured and found to be 0.6 μm.

100 parts by weight of the carrier body particles 4 and 0.040 parts by weight of the spherical silica particles A-4 obtained in Example 9 are blended by a V blender, as a result of which carrier particles in which the spherical silica particles A-4 are adhered to the surfaces of the carrier body particles are obtained.

95 parts by weight of the carrier particles obtained and 5 parts by weight of the toner particles 1 are blended by a V blender, thereby providing a developer 12.

Example 11

Preparation of Spherical Silica Particles A-5

A silica sol obtained by a sol-gel method is subjected to a treatment with hexamethyldisilazane (HMDS), followed by drying and pulverization, as a result of which spherical silica particles A-5 having a sphericity of $\psi=0.87$ and a volume average particle diameter of 300 nm are obtained.

Preparation of Carrier Body Particles 5

200 g (as solid weight) of dimethyl silicone resin containing a trifluoropropyl group (trade name, SR-2410 manufactured by Toray Dow Corning Corporation) is weighed out, and is dissolved in 1,000 cc of toluene solvent. Then, conductive carbon black (trade name, VULCAN XC72, manufactured by CABOT JAPAN K.K.) in an amount of 12 weight % relative to the amount of the solid of the resin and 2 g of an organic aluminum curing catalyst (aluminum-di-n-butoxide-mono-ethyl acetoacetate) are added thereto, and the resultant is dispersed by a pearl mill, as a result of which an inner layer formation solution is obtained.

Suitable amounts of raw materials are mixed to provide 30 mol % of MnO, 9.5 mol % of MgO, 60 mol % of $Fe_2O_3$, and 0.5 mol % of SrO, and water is added thereto. The resultant is pulverized and blended in a wet ball mill for 10 hours, and then dried. The resultant is left to stand at 800° C. for 4 hours, and thereafter subjected to pulverization in a wet ball mill for 24 hours. The slurry obtained is granulated and dried, and the resultant particles are left to stand at 1100° C. for 6 hours in an atmosphere having an oxygen concentration of 2%. Subsequently, the particles are crushed to control the particle size, as a result of which manganese-magnesium-strontium ferrite particles 5 are obtained.

The inner layer formation solution in which the carbon black is dispersed is applied, in an amount of 1.6 parts by weight in terms of the amount of the solid of the silicone resin, to 100 parts by weight of the manganese-magnesium-strontium ferrite particles 5 using a fluidized bed (spray dry) coating apparatus, and the resultant is dried at 100° C., thereby forming an inner resin layer.

Separately, a surface layer formation solution is prepared in the same manner as the preparation of the inner layer formation solution in Example 11, except that the amount of the carbon black is changed to 1.50 weight % relative to the amount of the solid of the resin. The surface layer formation solution is applied using a fluidized bed as a coating apparatus, thereby forming a surface layer on the inner resin layer. The amount of the surface layer formation solution applied is such that the amount of the solid of the silicone resin in the surface layer becomes 0.4 parts by weight. Thereafter, the particles are dried at 100° C. and are then baked at 270° C. for 1 hour. Then, the particles are subjected to a crushing treatment, and to a post-process using a vibration mill for 30 minutes, as a result of which carrier body particles 5 are obtained.

The volume average particle diameter of the carrier body particles 5 is 50 μm.

The surface roughness Ra of the carrier body particles 5 is measured and found to be 3.0 μm.

100 parts by weight of the carrier body particles 5 and 0.060 parts by weight of the spherical silica particles A-5 are blended by a V blender, as a result of which carrier particles in which the spherical silica particles A-5 are adhered to the surfaces of the carrier body particles are obtained.

95 parts by weight of the carrier particles obtained and 5 parts by weight of the toner particles 1 are blended by a V blender, thereby providing a developer 13.

Example 12

Preparation of Carrier Body Particles 6

200 g (as solid weight) of dimethyl silicone resin containing a trifluoropropyl group (trade name, SR-2410 manufactured by Toray Dow Corning Corporation) is weighed out, and is dissolved in 1,000 cc of toluene solvent. Then, conductive carbon black (trade name, VULCAN XC72, manufactured by CABOT JAPAN K.K.) in an amount of 12 weight % relative to the amount of the solid of the resin and 2 g of an organic aluminum curing catalyst (aluminum-di-n-butoxide-mono-ethyl acetoacetate) are added thereto, and the resultant is dispersed by a pearl mill, as a result of which an inner layer formation solution is obtained.

The inner layer formation solution in which the carbon black is dispersed is applied, in an amount of 1.4 parts by weight in terms of the amount of the solid of the silicone resin, to 100 parts by weight of the manganese-magnesium-strontium ferrite particles 5 obtained in Example 11, using a fluidized bed (spray dry) coating apparatus, and the resultant is dried at 100° C., thereby forming an inner resin layer.

Separately, a surface layer formation solution is prepared in the same manner as the preparation of the inner layer formation solution in Example 12, except that the amount of the carbon black is changed to 3.0 weight % relative to the amount of the solid of the resin. The surface layer formation solution is applied using a fluidized bed as a coating apparatus, thereby forming a surface layer on the inner resin layer. The amount of the surface layer formation solution applied is such that the amount of the solid of the silicone resin in the surface layer becomes 0.3 parts by weight. Thereafter, the particles are dried at 100° C. and are then baked at 270° C. for 1 hour. Then, the particles are subjected to a crushing treatment, and to a post-process using a vibration mill for 30 minutes, as a result of which a carrier body particles 6 are obtained.

The volume average particle diameter of the carrier body particles 6 is 50 μm.

The surface roughness Ra of the carrier body particles 6 is measured and found to be 3.2 μm.

100 parts by weight of the carrier body particles 6 and 0.060 parts by weight of the spherical silica particles A-5 obtained in Example 11 are blended by a V blender, as a result of which carrier particles in which the spherical silica particles A-5 are adhered to the surfaces of the carrier body particles are obtained.

95 parts by weight of the carrier particles obtained and 5 parts by weight of the toner particles 1 are blended by a V blender, thereby providing a developer 14.

Comparative Example 3

Preparation of Spherical Silica Particles A-6

A silica sol obtained by a sol-gel method is subjected to a treatment with hexamethyldisilazane (HMDS), followed by drying and pulverization, as a result of which spherical silica particles A-6 having a sphericity of ψ=0.90 and a volume average particle diameter of 30 nm are obtained.

100 parts by weight of the carrier body particles 1 obtained in Example 1 and 0.080 parts by weight of the spherical silica particles A-6 are blended by a V blender, as a result of which carrier particles in which the spherical silica particles A-6 are adhered to the surfaces of the carrier body particles are obtained.

95 parts by weight of the carrier particles obtained and 5 parts by weight of the toner particles 1 are blended by a V blender, thereby providing a developer 15.

Comparative Example 4

Preparation of Spherical Silica Particles A-7

A silica sol obtained by a sol-gel method is subjected to a treatment with hexamethyldisilazane (HMDS), followed by drying and pulverization, as a result of which spherical silica particles A-7 having a sphericity of ψ=0.89 and a volume average particle diameter of 45 nm are obtained.

100 parts by weight of the carrier body particles 1 obtained in Example 1 and 0.020 parts by weight of the spherical silica particles A-7 are blended by a V blender, as a result of which carrier particles in which the spherical silica particles A-7 are adhered to the surfaces of the carrier body particles are obtained.

95 parts by weight of the carrier particles obtained and 5 parts by weight of the toner particles 1 are blended by a V blender, thereby providing a developer 16.

Comparative Example 5

A developer 17 is obtained in the same manner as in Example 1, except that the amount of the spherical silica particles A-1 added is changed to 0.0008 parts by weight.

Comparative Example 6

Preparation of Spherical Silica Particles A-8

A silica sol obtained by a sol-gel method is subjected to a treatment with hexamethyldisilazane (HMDS), followed by drying and pulverization, as a result of which spherical silica particles A-8 having a sphericity of ψ=0.84 and a volume average particle diameter of 310 nm are obtained.

100 parts by weight of the carrier body particles 1 obtained in Example 1 and 0.050 parts by weight of the spherical silica particles A-8 are blended by a V blender, as a result of which carrier particles in which the spherical silica particles A-8 are adhered to the surfaces of the carrier body particles are obtained.

95 parts by weight of the carrier particles obtained and 5 parts by weight of the toner particles 1 are blended by a V blender, thereby providing a developer 18.

Evaluation Method

Evaluation is performed using a modified machine obtained by modifying a 650 J CONTINUOUS FEED PRINTING SYSTEM (trade name, manufactured by Fuji Xerox Co., Ltd.) to make the circumferential speed of the developer holding member variable. In the evaluation, the circumferential speed of the development roll is set to 1,050 minis, and the image holder used is an amorphous silicon image holder.

Using the modified machine in an environment of 28° C. and 80% RH, an image having a band-shaped pattern in a sheet conveyance direction is printed in a volume equivalent to about 10,000 A4 sheets after charging the developer; thereafter, an entire-surface half-tone image is printed in a volume equivalent to 50 A4 sheets at an image density set to 0.5, and band-shaped density unevenness on the half-tone image is evaluated with the naked eye according to the following evaluation criteria. The sheet used is NPi FORM 55 (trade name, manufactured by Nippon Paper Group, Inc.).

A: a level at which band-shaped density unevenness is not found at all with the naked eye.

B: a level at which band-shaped density unevenness is slightly observed, but is hardly noticeable.

C: a level at which band-shaped density unevenness is observed with the naked eye, and is intolerable level.

After the evaluation of the band-shaped density unevenness, a chart having an image density of 4% is printed in a volume equivalent to 300,000 A4 sheets. Thereafter, the band-shaped patterned image is printed again on 10 A4 sheets, and the optical density at a solid image region is measured using an X-Rite. The average value of optical densities measured on the last 10 sheets is represented by OD(300K), and the image density measured after printing first 10 sheets is represented by OD(INI). The absolute value of OD(300K)−OD(INI) is obtained, and stability of image density is evaluated according to the following evaluation criteria.

A: |OD(300K)−OD(INI)| is less than 0.05.

B: |OD(300K)−OD(INI)| is equal to or greater than 0.05 but less than 0.10.

C: |OD(300K)−OD(INI)| is equal to or greater than 0.10,

The evaluation results are shown in Table 1 below.

TABLE 1

| | Carrier | | | | | | | Evaluation Result | |
|---|---|---|---|---|---|---|---|---|---|
| | Carrier Body | | | Spherical Silica | | | | | |
| | Type | Particle Diameter (μm) | Ra (μm) | Type | Sphericity | Particle Diameter (nm) | Addition Amount | Band-like Image Density Unevenness | Image Density |
| Example 1 | 1 | 50 | 1.1 | A-1 | 0.88 | 130 | 0.030 | A | A |
| Example 2 | 1 | 50 | 1.1 | A-1 | 0.88 | 130 | 0.001 | B | A |

TABLE 1-continued

| | Carrier | | | | | | | | |
|---|---|---|---|---|---|---|---|---|---|
| | Carrier Body | | | Spherical Silica | | | | Evaluation Result | |
| | Type | Particle Diameter (μm) | Ra (μm) | Type | Sphericity | Particle Diameter (nm) | Addition Amount | Band-like Image Density Unevenness | Image Density |
| Example 3 | 1 | 50 | 1.1 | A-1 | 0.88 | 130 | 0.100 | A | B |
| Example 4 | 1 | 50 | 1.1 | A-1 | 0.88 | 130 | 0.080 | A | A |
| Example 5 | 2 | 45 | 0.8 | A-2 | 0.90 | 50 | 0.025 | B | A |
| Example 6 | 2 | 45 | 0.8 | A-2 | 0.90 | 50 | 0.005 | B | A |
| Example 7 | 3 | 60 | 2.0 | A-3 | 0.80 | 80 | 0.020 | A | A |
| Example 8 | 3 | 60 | 2.0 | A-3 | 0.80 | 80 | 0.080 | A | A |
| Example 9 | 3 | 60 | 2.0 | A-4 | 0.85 | 200 | 0.040 | A | A |
| Example 10 | 4 | 50 | 0.6 | A-4 | 0.85 | 200 | 0.040 | B | A |
| Example 11 | 5 | 50 | 3.0 | A-5 | 0.87 | 300 | 0.060 | B | A |
| Example 12 | 6 | 50 | 3.2 | A-5 | 0.87 | 300 | 0.060 | B | B |
| Comparative Example 1 | 1 | 50 | 1.1 | — | — | — | 0 | C | A |
| Comparative Example 2 | 1 | 50 | 1.1 | A-1 | 0.88 | 130 | 0.140 | B | C |
| Comparative Example 3 | 1 | 50 | 1.1 | A-6 | 0.90 | 30 | 0.080 | C | A |
| Comparative Example 4 | 1 | 50 | 1.1 | A-7 | 0.89 | 45 | 0.020 | C | A |
| Comparative Example 5 | 1 | 50 | 1.1 | A-1 | 0.88 | 130 | 0.0008 | C | A |
| Comparative Example 6 | 1 | 50 | 1.1 | A-8 | 0.84 | 310 | 0.050 | C | B |

While some exemplary embodiments are described above, the invention is not limited to the above exemplary embodiments.

What is claimed is:

1. A carrier for electrostatic image development, comprising:

a carrier body including a core and a resin coating layer on the core; and first spherical silica particles having a volume-average particle diameter of from 50 nm to 300 nm that are externally added and adhered to the surface of the carrier body, which already has the resin coating layer on the core, at a ratio of from 0.001 parts by weight to 0.080 parts by weight relative to 100 parts by weight of the carrier body, wherein an average of the sphericity of the first spherical silica particles as defined by the following expression is equal to or greater than 0.8:

Sphericity=(a surface area of a sphere having the same volume as an actual particle)/(a surface area of the actual particle).

2. The carrier for electrostatic image development according to claim 1, wherein the surface roughness Ra of the carrier body is in a range of from 0.6 μm to 3.0 μm.

3. The carrier for electrostatic image development according to claim 1, wherein the resin coating layer comprises a conductive material and a resin, and the content ratio of the conductive material at a surface-side portion of the resin coating layer is smaller than the content ratio of the conductive material at a core-side portion of the resin coating layer.

4. The carrier for electrostatic image development according to claim 3, wherein the outermost surface of the resin coating layer comprises a cross-linked resin.

5. The carrier for electrostatic image development according to claim 4, wherein the cross-linked resin is a silicone resin.

6. The carrier for electrostatic image development according to claim 1, wherein the first silica particles are hexamethyldisilazane-treated silica particles.

7. The carrier for electrostatic image development according to claim 1, wherein the volume average particle diameter of the core of the carrier is from 10 μm to 200 μm.

8. An electrostatic image developer comprising the carrier for electrostatic image development according to claim 1, and a toner.

9. The electrostatic image developer according to claim 8, wherein the toner comprises a binder resin having a glass transition temperature Tg of from 50° C. to 80° C.

10. The electrostatic image developer according to claim 9, wherein the binder resin is a polyester resin.

11. The electrostatic image developer according to claim 10, wherein the polyester resin is formed from at least one monomer including an alkylene oxide adduct of bisphenol A.

12. The electrostatic image developer according to claim 8, wherein the toner comprises wax at a content of from 0.5% by weight to 10% by weight relative to the entire toner.

13. The electrostatic image developer according to claim 12, wherein the wax exhibits an endothermal peak at a temperature of from 50° C. to 200° C. in differential scanning calorimetry (DSC).

14. The electrostatic image developer according to claim 8, wherein the toner comprises:

toner mother particles containing a binder resin and a colorant; and second silica particles having, on a surface thereof, a treatment layer containing a silane coupling agent having an amino group.

15. The carrier for electrostatic image development according to claim 1, wherein the first silica particles are at a ratio of from 0.003 parts by weight to 0.080 parts by weight relative to 100 parts by weight of the carrier body.

16. The carrier for electrostatic image development according to claim 1, wherein the first silica particles are at a ratio of from 0.005 parts by weight to 0.060 parts by weight relative to 100 parts by weight of the carrier body.

17. The carrier for electrostatic image development according to claim 1, wherein the surface roughness Ra of the carrier body is in a range of from 0.7 μm to 3.0 μm.

18. The carrier for electrostatic image development according to claim 1, wherein the surface roughness Ra of the carrier body is in a range of from 0.7 μm to 2.5 μm.

19. The carrier for electrostatic image development according to claim 1, wherein the surface roughness Ra of the carrier body is in a range of from 0.8 μm to 2.0 μm.

* * * * *